US006705879B2

(12) United States Patent
Engel et al.

(10) Patent No.: US 6,705,879 B2
(45) Date of Patent: Mar. 16, 2004

(54) PLUGGABLE ELECTRICAL TRANSCEIVER MODULE WITH HIGH DENSITY FORM FACTOR

(75) Inventors: Andy Engel, Portola Valley, CA (US); Janet L. Yun, Santa Clara, CA (US); Kendra Gallup, Sunnyvale, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 17 days.

(21) Appl. No.: 10/214,337

(22) Filed: Aug. 7, 2002

(65) Prior Publication Data

US 2004/0029417 A1 Feb. 12, 2004

(51) Int. Cl.[7] ..... H01R 12/00

(52) U.S. Cl. ..... 439/76.1; 439/607; 439/372; 439/157; 361/816

(58) Field of Search ..... 439/76.1, 607, 439/372, 157; 361/816

(56) References Cited

U.S. PATENT DOCUMENTS

| | | | | |
|---|---|---|---|---|
| 6,074,228 A | * | 6/2000 | Berg et al. | 439/180 |
| 6,335,869 B1 | * | 1/2002 | Branch et al. | 361/816 |
| 6,430,053 B1 | * | 8/2002 | Peterson et al. | 361/728 |
| 6,439,918 B1 | * | 8/2002 | Togami et al. | 439/372 |

OTHER PUBLICATIONS

LC Product Overview, available at www.siemon.com with a web address of http://www.siemon.com/e–catalogXML/familylist.asp?FAM=fi_lcproductoverview.

MT–RJ Product Overview, available at www.siemon.com with a web address of http://www.siemon.com/e–catalogXML/familylist.asp?FAM=fi_mtrjprodoverview.

Small Form Factor Pluggable (SFP) Transceiver Multi-Source Agreement (MSA) "Cooperation Agreement for Small Form–Factor Pluggable Transceivers" http://www.schelto.com/SFP/index.html——> Final SFP MSA Document in pdf format.

* cited by examiner

*Primary Examiner*—Tho D. Ta
*Assistant Examiner*—Truc Nguyen

(57) ABSTRACT

A transceiver module is adapted to be plugged into a port cage within a host system. The transceiver module includes transceiver electronics and a connector attached to the transceiver electronics. The transceiver electronics are sized to fit within the port cage. The connector includes a module portion and a connector jack attached to the module portion. The module portion is sized to fit along with the transceiver electronics within the port cage. The connector jack is sized with dimensions too big to fit within the port cage. The connector jack remains out of the port cage when the transceiver module is placed within the port cage. The connector jack occupies an area larger than an opening of the port cage.

19 Claims, 6 Drawing Sheets

PLUGGABLE ELECTRICAL TRANSCEIVER MODULE WITH HIGH DENSITY FORM FACTOR

BACKGROUND

The present invention pertains to networking systems and pertains particularly to a pluggable electrical transceiver module with a high density form factor.

Switches, routers and other networking devices often require many ports for connection to additional devices. The size and number of connectors for which ports are required can have an influence on size and shape of the network devices.

For example, switches that utilize the Gigabit Ethernet protocol can have 48, 60 or more ports. Within each port can be placed a transceiver module that includes a connector, printed circuit board (PCB) and housing. The transceiver module translates the data from a format suitable for the cable to a format suitable for the host system, and vice versa. Transceiver modules for use with fiber optic cable are known as "electro-optic transceiver modules". Electro-optic transceiver modules translate optical signals to electrical signals and vice-versa. Transceiver modules for use with electrical cable are known as "electrical transceiver modules". Electrical transceiver modules translate electrical signals from an electrical format suitable for electrical cable to another electrical format suitable for the host system, and vice versa. Typically, for the Gigabit Ethernet protocol, an electrical or optical cable with a suitable connector is used to connect to the switch, router or other network device.

Optical connectors that have a relatively narrow circumference, such as an MTRJ or LC optical connector, allow for network devices to have densely arranged ports. However, for switches that use electrical connectors that are larger in size, such as RJ 45 connectors, larger, less densely arranged ports have been required. This can result in network devices that require additional space to accommodate the bigger port size.

SUMMARY OF THE INVENTION

In accordance with the preferred embodiment of the present invention, a transceiver module is presented. The transceiver module is adapted to be plugged into a port cage within a host system. The transceiver module includes transceiver electronics and a connector attached to the transceiver electronics. The transceiver electronics are sized to fit within the port cage. The connector includes a module portion and a connector jack attached to the module portion. The module portion is sized to fit along with the transceiver electronics within the port cage. The connector jack is sized with dimensions too big to fit within the port cage. The connector jack remains out of the port cage when the transceiver module is placed within the port cage. The connector jack occupies an area larger than an opening of the port cage.

DESCRIPTION OF THE PREFERRED EMBODIMENT

Figure 1:
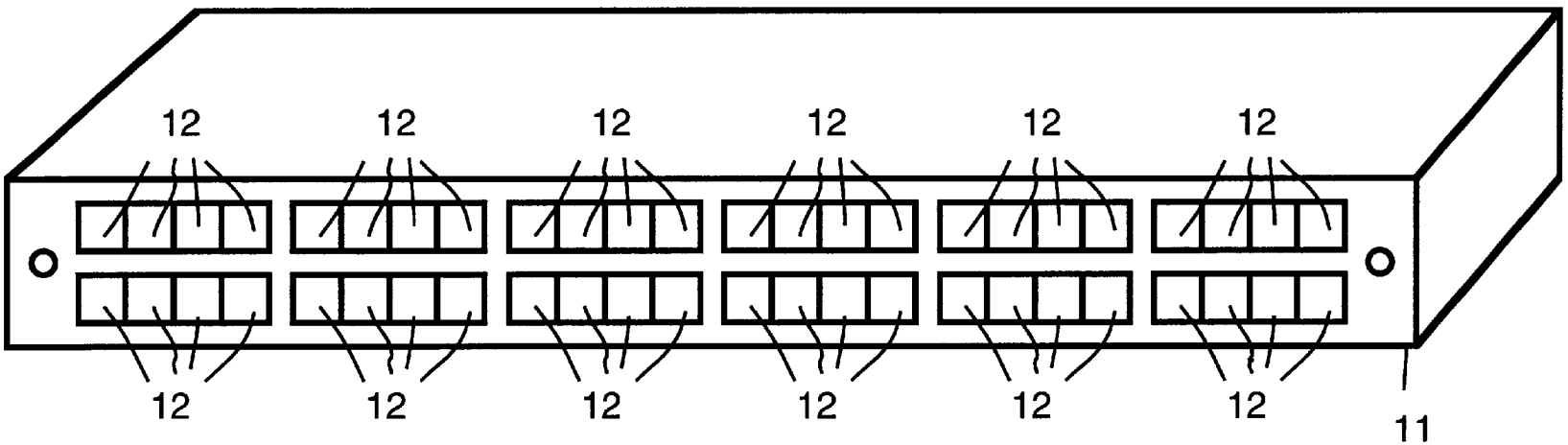
FIG. 1 (PRIOR ART)
FIG. 1 is a simplified drawing of a host system such as a network switch.

FIG. 1 is a simplified drawing of a host system. For example, host system is a networking switch, router, or some other networking device. Host system 11 has a number of ports 12. The ports are implemented as cages designed to receive an electro-optic transceiver module with a small form factor, such as an electro-optic transceiver module used to hold an MTRJ or LC or other type of electro-optic connector, or as an electrical transceiver module used to hold an RJ 45 or another type of electrical connector.

Figure 2:
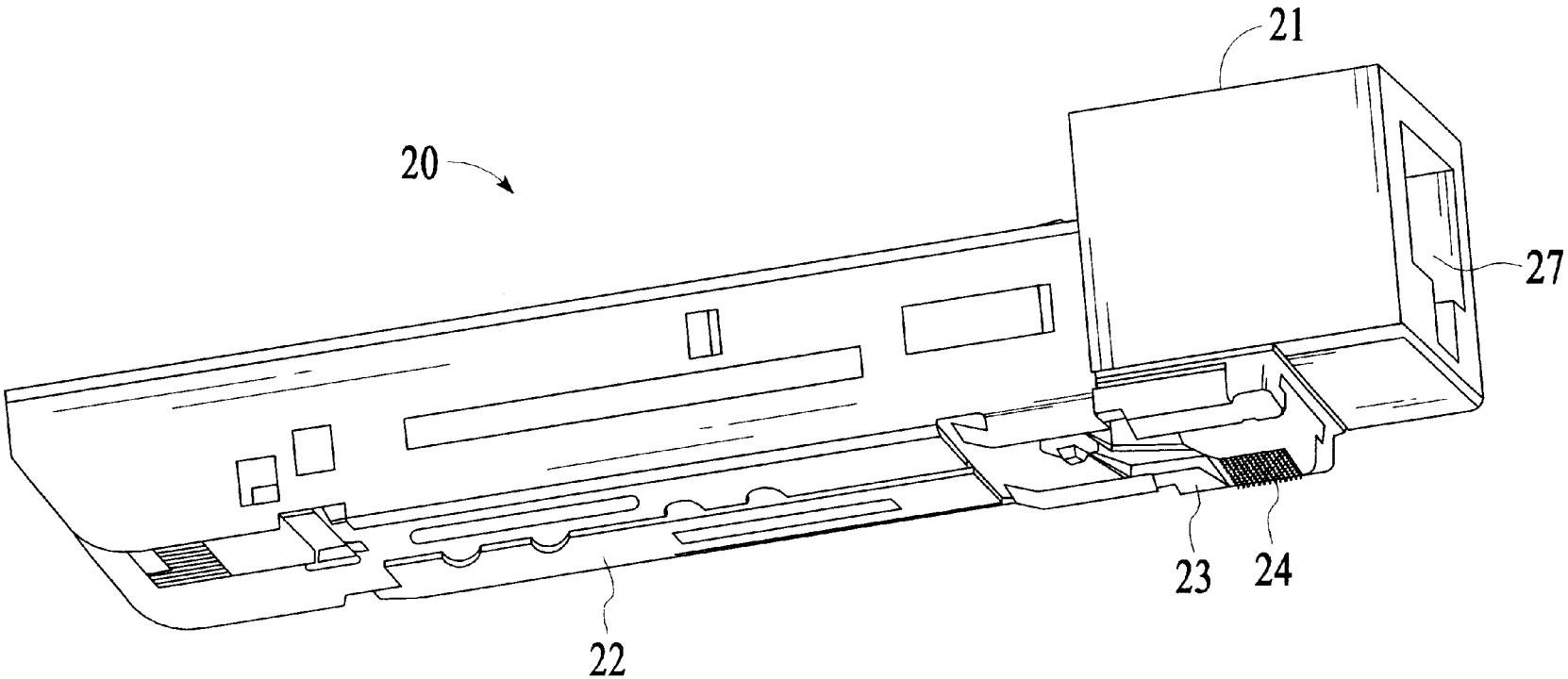
FIG. 2 shows an electrical transceiver module in accordance with a preferred embodiment of the present invention.

FIG. 2 shows an electrical transceiver module 20 that can be placed in a port of a host system, for example, one of ports 12 of host system 11. Electrical transceiver module 20 passes data from a cable to its host system.

Electrical transceiver module 20 includes an opening 27 within an RJ-45 jack 21 into which a cable fits. For example, the cable is a category (CAT) 5 cable. Alternatively, the cable can be, for example, a category 3, 5e or 6 cable for Ethernet, fast Ethernet or gigabit Ethernet applications.

For example, electrical transceiver module 20 is a "small-form pluggable" transceiver. The small form-factor allows for a high density of transceivers, so a maximum number of modules can fit into a given system.

A portion 22 of electrical transceiver module 20 is placed within a port cage of the host system. A latching mechanism 23 secures electrical transceiver module 20 in the port cage. A delatch 24 is shown inserted within latching mechanism 23. RJ-45 jack 21 sticks out of the cage of the host system.

Figure 3:
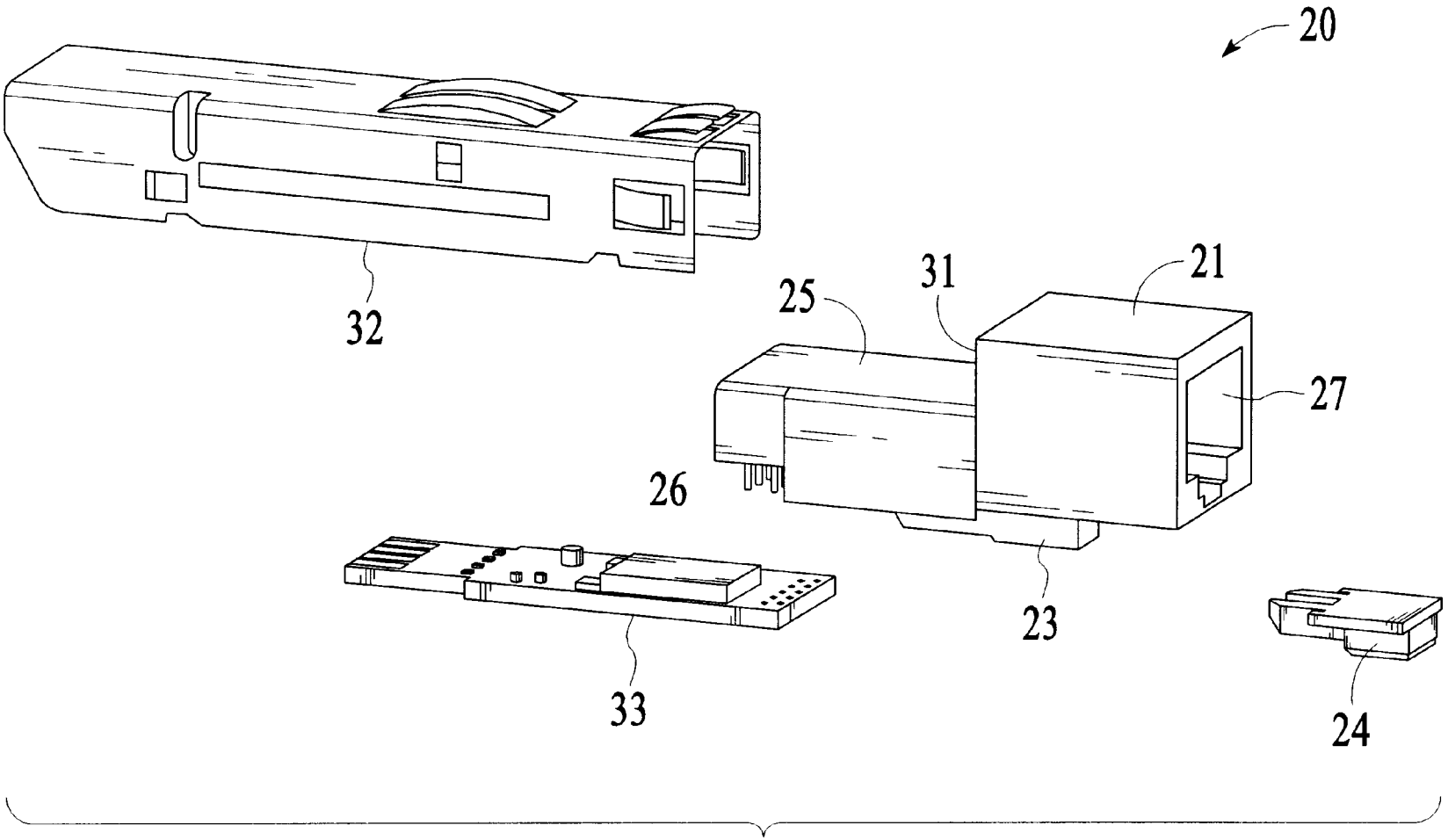
FIG. 3 shows an expanded view of the electrical transceiver module shown in FIG. 2 in accordance with a preferred embodiment of the present invention.

FIG. 3 shows an expanded view of electrical transceiver module 20. Electrical transceiver module 20 includes a connector 31, a printed circuit board (PCB) 33 and a housing 32. Housing 32 includes electro-magnetic interference (EMI) shielding. Connector 31 also includes EMI shielding over RJ 45 jack 21 and over a module side 25 of connector 31. In addition to reducing EMI, the shielding also reduces cross-talk. The EMI shielding is connected to chassis ground.

Module side 25 of connector 31 includes a 10-pin connector 26 for connection to PCB 33. Delatch 24 is shown removed from latching mechanism 23. PCB 33 implements a transceiver.

Figure 4:
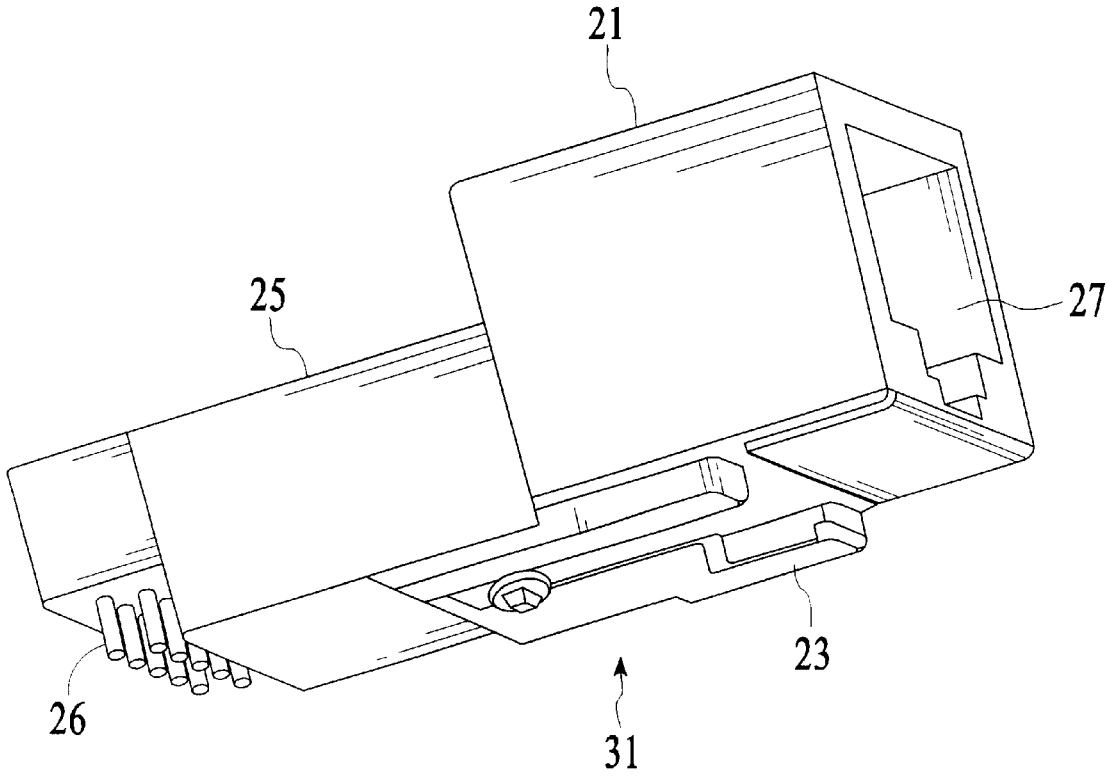
FIG. 4 shows an alternate view of a connector portion of the electrical transceiver module shown in FIG. 2 in accordance with a preferred embodiment of the present invention.

FIG. 4 shows an alternate view of connector 31. The alternate view allows a clear view of latching mechanism 23 being integrated as part of connector 30. 10-pin connector 26 is also clearly seen.

Figure 5:
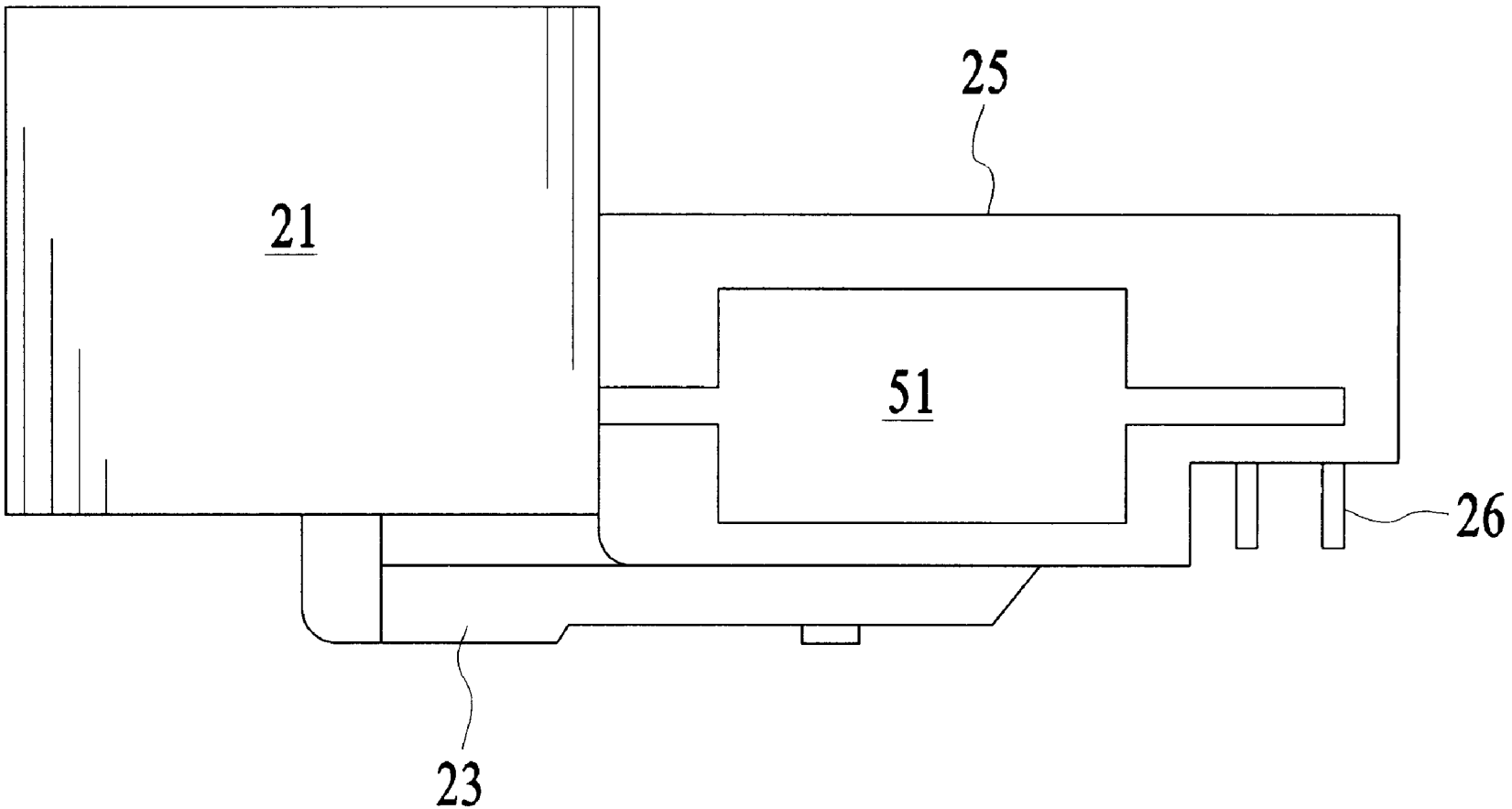
FIG. 5 shows section view of the connector shown in FIG. 4 in accordance with a preferred embodiment of the present invention.

FIG. 5 shows a section view of connector 31. A magnetic circuit 51 is included within module side 25 of connector 31. All incoming and outgoing signals communicated through connector 31 pass through magnetic circuit 51. For example, magnetic circuit 51 consists of a transformer for electrical isolation between the cable within RJ 45 jack 21 and the transceiver implemented by PCB 33. Magnetic circuit 51 also includes a common mode choke and a common mode termination.

Figure 6:
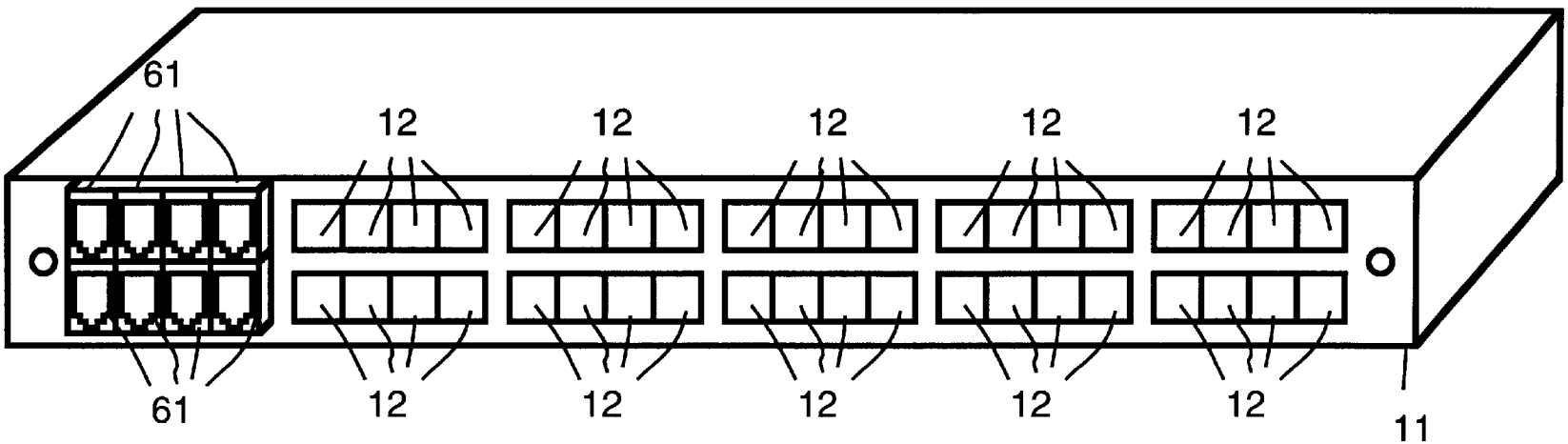
FIG. 6 is a simplified drawing of electrical transceiver modules inserted in a host system in accordance with a preferred embodiment of the present invention.

FIG. 6 is a simplified drawing showing electrical transceiver modules 61 inserted in a host system. The jack portions of the electrical transceiver modules extend out of ports 12 allowing for a dense arrangement of ports 12. The small form-factor allows for a high density of transceivers, so a maximum number of modules can fit into a given system. This results in minimal impact on the ability of host system 11 to house a high density of electrical transceiver modules.

The foregoing discussion discloses and describes merely exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

We claim:

1. A transceiver module to be plugged into a port cage within a host system, the transceiver module comprising:

transceiver electronics, the transceiver electronics being sized to fit within the port cage; and, a connector attached to the transceiver electronics, the connector comprising:

a module portion that is sized to fit along with the transceiver electronics within the port cage, and a connector jack attached to the module portion, the connector jack being sized with dimensions too big to fit within the port cage, the connector jack remaining out of the port cage when the transceiver module is placed within the port cage, the connector jack occupying an area larger than an opening of the port cage.

2. A transceiver module as in claim 1 wherein the transceiver electronics are implemented on a printed circuit board attached to the connector.

3. A transceiver module as in claim 1 additionally comprising:

housing that covers the transceiver electronics, the housing including electro-magnetic interference (EMI) shielding.

4. A transceiver module as in claim 1 wherein the connector additionally comprises:

electro-magnetic interference (EMI) shielding over both the module portion and the connector jack.

5. A transceiver module as in claim 1 wherein the module portion includes:

magnetic circuitry.

6. A transceiver module as in claim 1 wherein the module portion includes:

magnetic circuitry composed of a transformer, a common mode choke and a commode mode termination.

7. A transceiver module as in claim 1 wherein the connector additionally comprises:

a latching mechanism that secures the transceiver module to the port cage.

8. A connector as in claim 1 wherein the module portion includes:

magnetic circuitry.

9. A connector as in claim 1 wherein the module portion includes:

magnetic circuitry composed of a transformer, a common mode choke and a commode mode termination.

10. A connector as in claim 1 additionally comprising:

a latching mechanism that secures the transceiver module to the port cage.

11. A transceiver module to be plugged into a port cage within a host system, the transceiver module comprising:

transceiver means for implementing a transceiver, the transceiver means being sized to fit within the port cage; and, a connector means for connecting a cable to the transceiver means, the connector means comprising:

a module means for being placed along with the transceiver means within the port cage, and a jack means for receiving the cable, the jack means being sized with dimensions too big to fit within the port cage, the jack means remaining out of the port cage when the transceiver module is placed within the port cage, the jack means occupying an area larger than an opening of the port cage.

12. A transceiver module as in claim 11 wherein the transceiver means is implemented on a printed circuit board attached to the connector means.

13. A transceiver module as in claim 11 additionally comprising:

housing means for covering the transceiver means, the housing including electro-magnetic interference (EMI) shielding.

14. A transceiver module as in claim 11 wherein the connector means additionally comprises:

shielding means for providing electro-magnetic interference (EMI) shielding over both the module means and the jack means.

15. A transceiver module as in claim 11 wherein the module means includes:

magnetic circuitry.

16. A transceiver module as in claim 11 wherein the module means includes:

magnetic circuitry composed of a transformer, a common mode choke and a commode mode termination.

17. A transceiver module as in claim 11 wherein the connector means additionally comprises:

a latching means for securing the transceiver module to the port cage.

18. A connector for use within transceiver module to be plugged into a port cage within a host system, the connector comprising:

a module portion that is sized to fit along with transceiver electronics within the port cage, and a connector jack attached to the module portion, the connector jack being sized with dimensions too big to fit within the port cage, the connector jack remaining out of the port cage when the transceiver module is placed within the port cage, the connector jack occupying an area larger than an opening of the port cage.

19. A connector as in claim 18 additionally comprising:

electro-magnetic interference (EMI) shielding over both the module portion and the connector jack.

* * * * *